US007014206B2

(12) United States Patent
Donzé

(10) Patent No.: US 7,014,206 B2
(45) Date of Patent: Mar. 21, 2006

(54) SKI AND SNOW BOARD WITH VARIABLE RADIAL GEOMETRY

(75) Inventor: Claude Donzé, Vercorin (CH)

(73) Assignee: SCOTT Sports SA, Givisiez (CH)

( * ) Notice: Subject to any disclaimer, the term of this patent is extended or adjusted under 35 U.S.C. 154(b) by 114 days.

(21) Appl. No.: 10/432,022

(22) PCT Filed: Nov. 12, 2001

(86) PCT No.: PCT/CH01/00662

§ 371 (c)(1),
(2), (4) Date: May 19, 2003

(87) PCT Pub. No.: WO02/40115

PCT Pub. Date: May 23, 2002

(65) Prior Publication Data

US 2004/0026893 A1 Feb. 12, 2004

(30) Foreign Application Priority Data

Nov. 17, 2000 (CH) ..... 2260/00

(51) Int. Cl.
*A63C 5/07* (2006.01)

(52) U.S. Cl. ..... 280/602; 280/610

(58) Field of Classification Search ..... 280/601, 280/602, 607, 609, 610, 618
See application file for complete search history.

(56) References Cited

U.S. PATENT DOCUMENTS

| | | | | |
|---|---|---|---|---|
| 2,377,504 | A * | 6/1945 | Lermont | 280/601 |
| 4,071,264 | A * | 1/1978 | Legrand et al. | 280/610 |
| 4,706,985 | A * | 11/1987 | Meatto | 280/610 |
| 5,002,301 | A * | 3/1991 | Cagneux et al. | 280/602 |
| 5,238,260 | A * | 8/1993 | Scherubl | 280/610 |
| 5,326,126 | A * | 7/1994 | Ruffinengo | 280/602 |
| 5,597,170 | A * | 1/1997 | Le Masson et al. | 280/602 |
| 6,158,747 | A * | 12/2000 | Magnani | 280/11.14 |
| 6,182,998 | B1 * | 2/2001 | Huyghe et al. | 280/602 |
| 6,193,262 | B1 * | 2/2001 | Silva | 280/607 |
| 6,270,108 | B1 * | 8/2001 | Phelipon et al. | 280/602 |
| 6,520,529 | B1 * | 2/2003 | DeRocco et al. | 280/610 |
| 6,679,513 | B1 * | 1/2004 | Emig et al. | 280/602 |
| 6,679,514 | B1 * | 1/2004 | Luitz et al. | 280/607 |

FOREIGN PATENT DOCUMENTS

| | | |
|---|---|---|
| DE | 32 23 413 | 1/1983 |
| EP | 1 032 460 | 9/2000 |

* cited by examiner

*Primary Examiner*—Christopher P. Ellis
*Assistant Examiner*—Christopher Bottorff
(74) *Attorney, Agent, or Firm*—Oblon, Spivak, McClelland, Maier & Neustadt, P.C.

(57) ABSTRACT

A ski having a sandwich-like construction including rods and slit stops for changing a radial geometry of the ski. When the ski flexes, the rods and the ski change their respective radii differentially, causing changes in the slit stops. In turn, the slit stops spread or constrict to change maneuvering characteristics of the ski.

9 Claims, 5 Drawing Sheets

SKI AND SNOW BOARD WITH VARIABLE RADIAL GEOMETRY

FIELD OF THE INVENTION

The present invention relates to a ski and snow board for alpine skiing and snowboarding.

SUMMARY OF THE INVENTION

The present invention relates to a ski or a snowboard (both of which are herein referred to as a "ski") having a sandwich-like (or monocoque) construction. The ski has two rods, both made of non-compressible material and both including a conical end part and a tension rod. The ski further includes slit stops on two ends of the ski, either mounted on the ski or incorporated into the ski, shaped like ray wings and partially slit down the center. The slit stops include conical bores along the axis of the ski that receive the respective conical ends of the rods. In addition, the ski includes rod guides to stabilize the rods.

By operation of the rods and the slit stops, the radial geometry of the ski is modified when the ski flexes longitudinally, resulting in improved maneuverability and operation of the ski.

BRIEF DESCRIPTION OF THE DRAWINGS

These objects and other objects and advantages of the present invention will become more apparent upon reading of the following detailed description and the accompanying drawings in which:

FIG. 2E(ii) is a detail in profile view of the tension rod shown in FIG. 2B labeled "E";

DETAILED DESCRIPTION OF THE PREFERRED EMBODIMENTS

Discussion follows hereinbelow of an embodiment of the present invention based on the accompanying drawings.

Figures 1A, 1B, 1C:
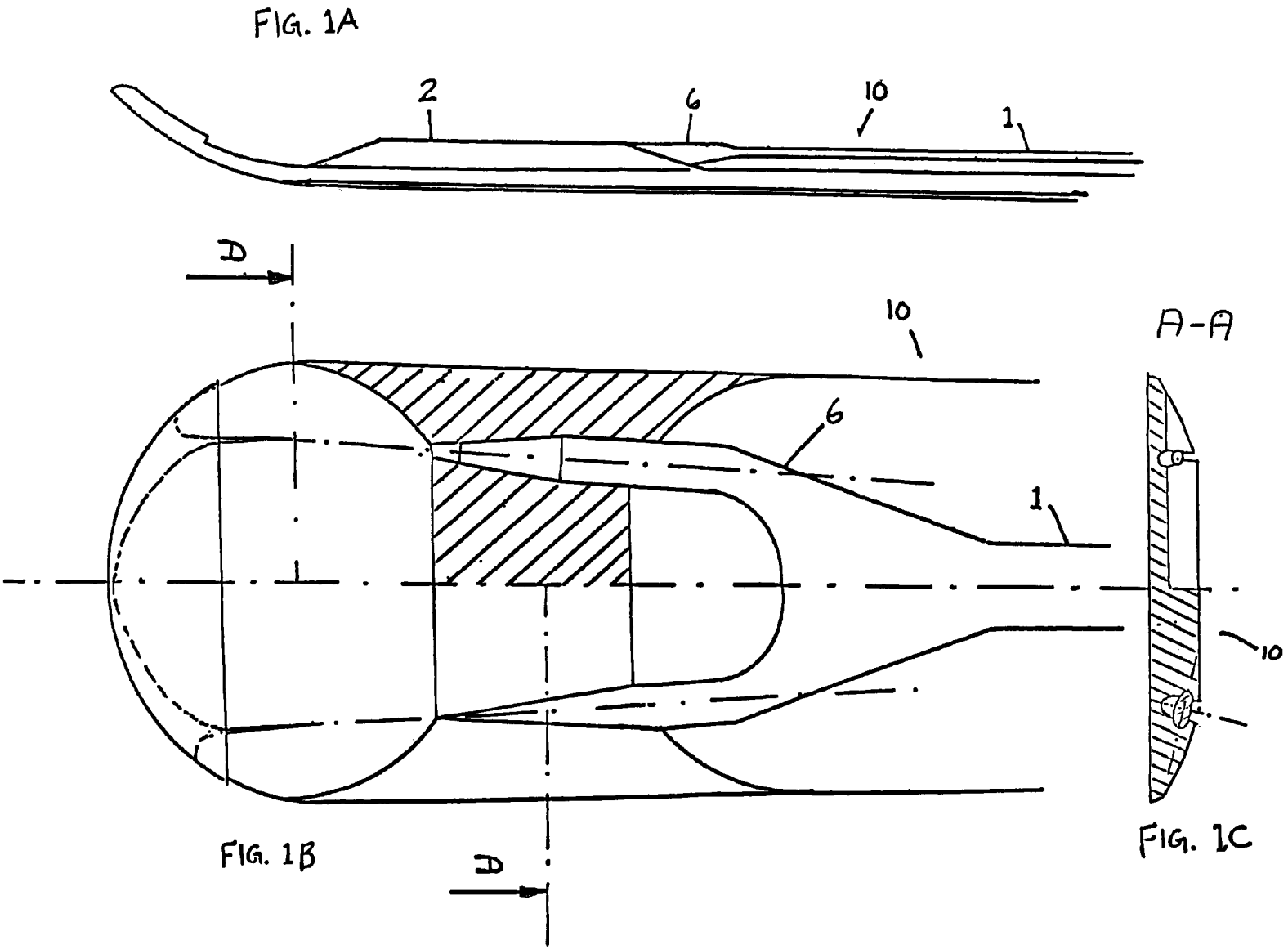
FIG. 1A is a profile view of a ski showing the mechanical structure described herein according to an embodiment of the present invention.
FIG. 1B is a plan view of the ski body shown in FIG. 1A.
FIG. 1C is a plane view along the section marked by the line A—A shown in FIG. 1B.
Figures 2A, 2B, 2C, 2D, 2E:
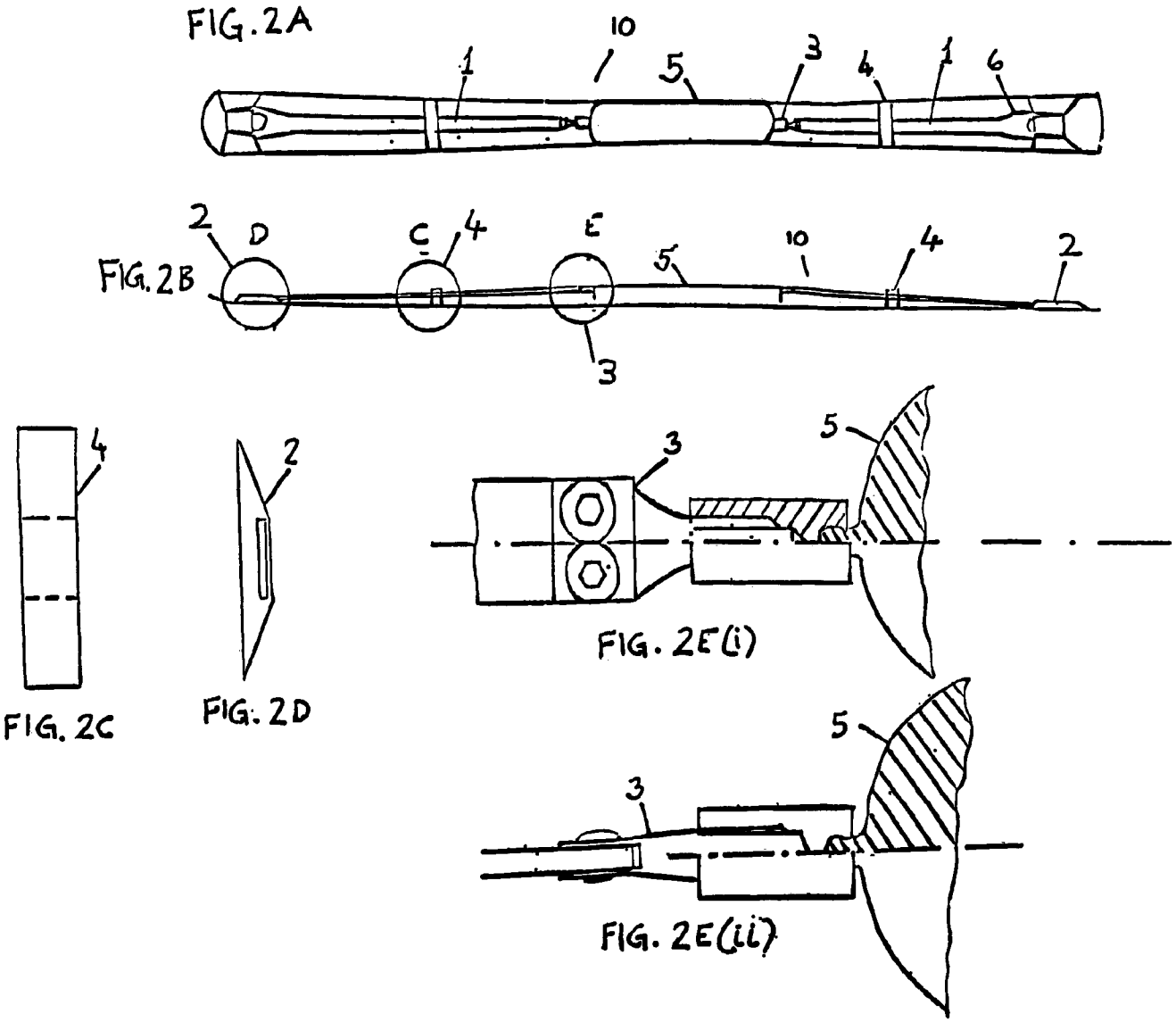
FIG. 2A is a plan view of a ski according to an embodiment of the present invention.
FIG. 2B is a profile view of the ski shown in FIG. 2A.
FIG. 2C is a detail of the rod guide shown in FIG. 2B labeled "C"
FIG. 2D is a detail of the slit stop shown in FIG. 2B labeled "D"
FIG. 2E(i) is a detail in plan view of the tension rod shown in FIG. 2B labeled "E"

As shown in FIG. 2A, a ski 10 having sandwich-like construction has two rods 1, both made of flexible but non-compressible material and both including a conical end part 6 on one end and a tension rod 3 on another end. The ski further includes slit stops 2 on two ends of the ski, either mounted on the ski or incorporated into the ski, shaped like ray wings and partially slit down the center, as shown in FIGS. 1A–1C. The slit stops 2 include conical bores along the axis of the ski that receive the respective conical ends 6 of the rods 1.

According to the preferred embodiment, the rods 1 are constructed of carbon fiber. A metallic cone 6 is glued to one end of the rods 1, and a socket 3 having external threading is glued to another respective end of the rods 1.

In the preferred embodiment, the slit stops 2 formed in the shape of ray wings are made of composite material formed through molding, and are incorporated into the ski 10 by gluing. The conical bore of the slit stops 2 are formed of separate elements that are resistant to wear. The tension rods 3 include threading by which the tension rods are screwed onto the rods 1. The tension rods 3 bear on the ski plate or the mounting 5.

Further, rod guides 4 of synthetic material are glued on an upper face of the ski 1, according to the preferred embodiment, and the slit stops 2 and the rod guides 4 are fixed on the ski 10 at predetermined places. After the slit stops 2 and the rod guides 4 are fixed to the ski 1, the rods 1 and the tension rods 3 are mounted.

Figure 5:
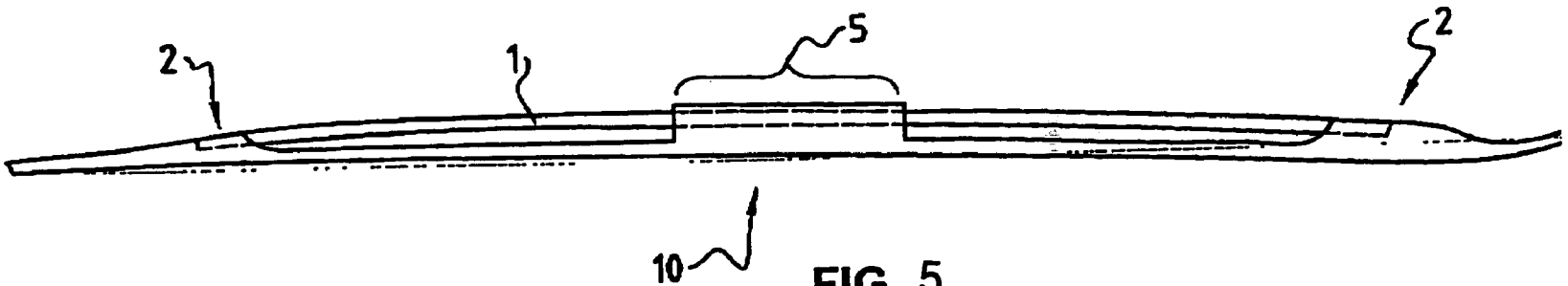
FIG. 5 is a side view of a ski which shows a rod extending over the entire length of a ski and grasped solely between slit stops.
Figure 6:
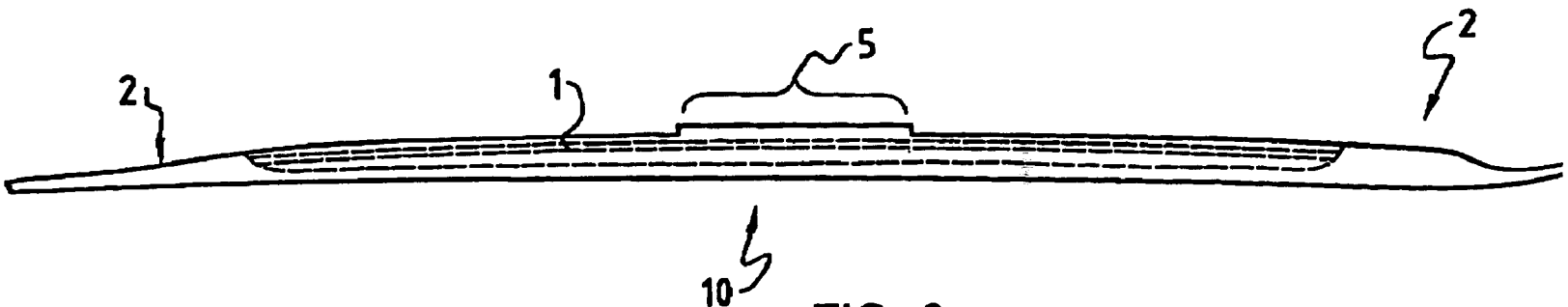
FIG. 6 is a side view of a ski which shows a rod and slip stop incorporated under the upper surface of a ski.

FIGS. 3A–3D show the ski 10 when the ski is not under flexion. When the ski 10 flexes longitudinally as shown in FIGS. 3E–3H, the radial geometry of the ski is modified by the difference in change of respective radii of the rods 1 and of the ski 10. According to the modification of the radial geometry of the ski 10, the conical ends 6 of the rods advance into the bores of the slit stops 2. Consequently, the advancement of the rods causes the slit stops 2 to open by acting directly on the radial geometry of the ski 10. FIG. 5 shows a rod 1 extend over the entire length of the ski. FIG. 5 also shows a rod 1 grasped solely by the slit stops 2. FIG. 6 shows a rod 1 and slit stop 2 incorporated under the upper surface of the ski.

Figures 3A, 3B, 3C, 3D, 3E, 3F, 3G, 3H:
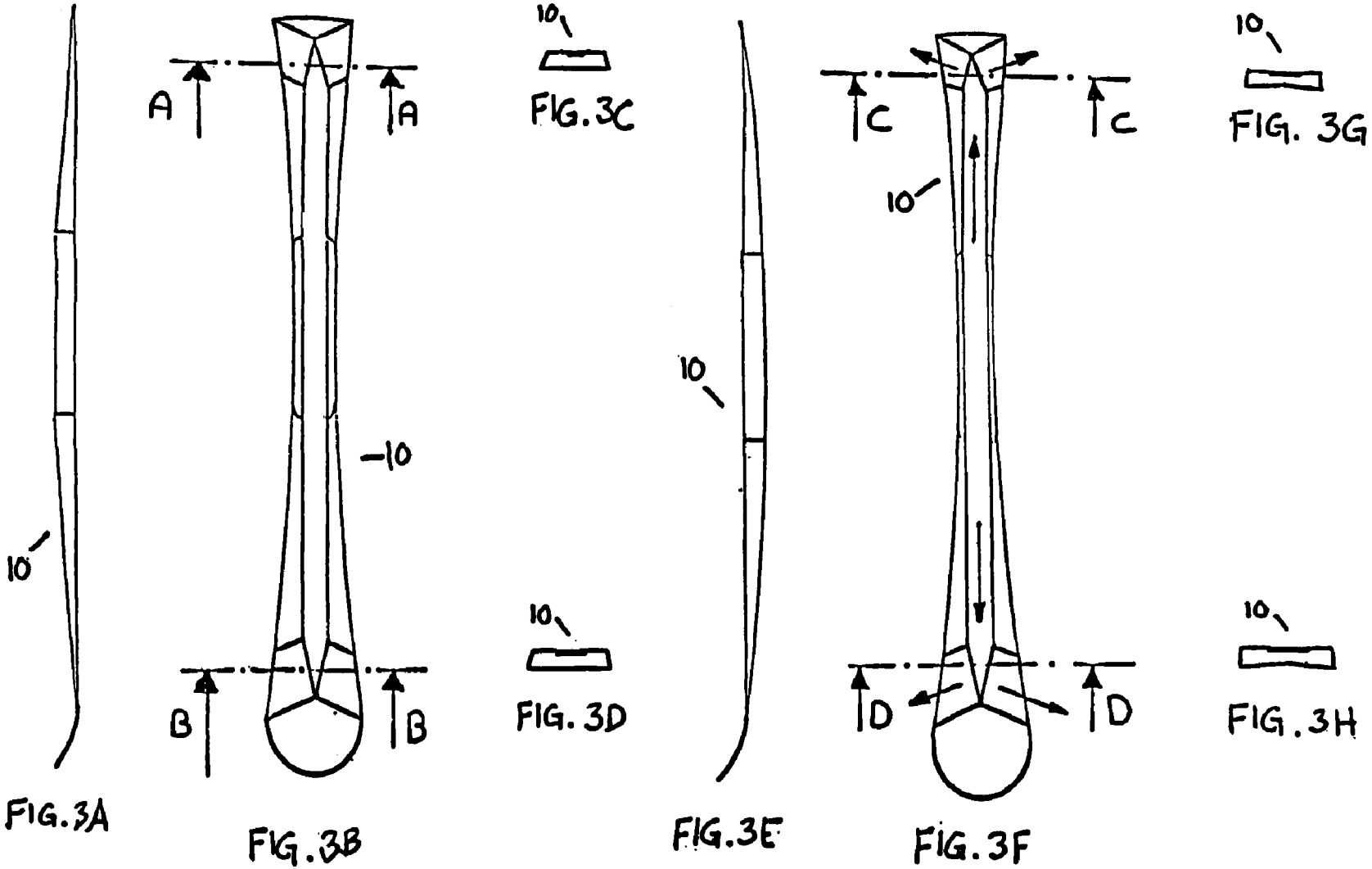
FIG. 3A is a profile view of the ski body according to an embodiment of the present invention without flexion.
FIG. 3B is a plan view of the ski body shown in FIG. 3A.
FIG. 3C is a section view along the plane A—A shown in FIG. 3B.
FIG. 3D is a section view along the plane B—B shown in FIG. 3B.
FIG. 3E is a profile view of the ski body according to an embodiment of the present invention being flexed.
FIG. 3F is a profile view of the ski body shown in FIG. 3E, further showing the direction of forces applied to the ski body being flexed.
FIG. 3G is a section view along the plane C—C shown in FIG. 3F.
FIG. 3H is a section view along the plane D—D shown in FIG. 3F.

As an advantage, the radial geometry of the ski grows progressively concave as it curves, which guides and facilitates the maneuvering of the ski, as shown in FIG. 3F.

In addition, characteristics of the rods may be adjusted or the rods may be replaced with rods having characteristics suited for various situations—for example, by adjusting the active length of the rods.

Figure 4:
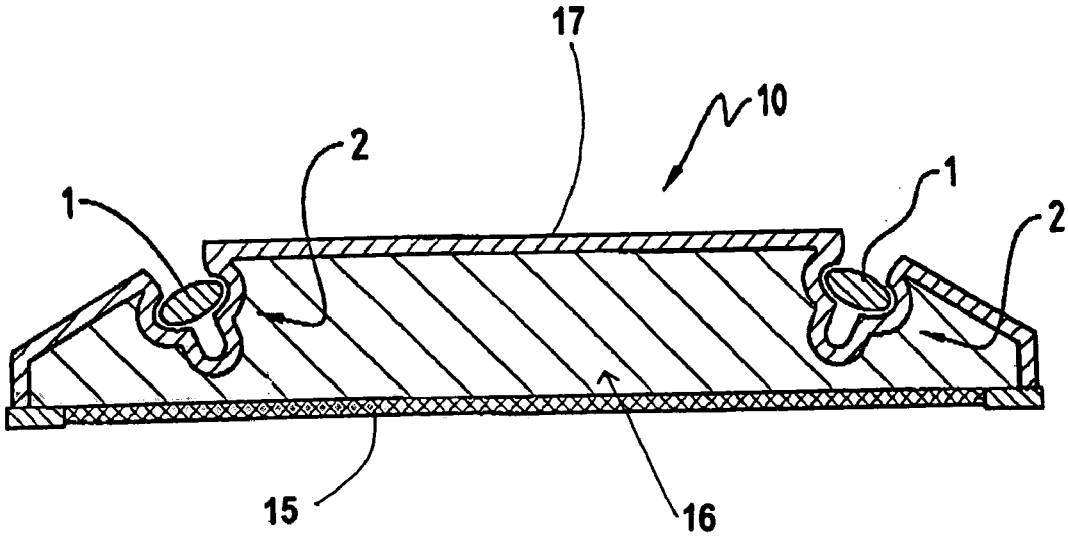
FIG. 4 is a section view of a ski showing monocoque construction of a ski.

As a further advantage, the construction of the ski including rods and slit stops may reduce vibration of the ski, and the geometry of the ski provides optimal performance in all situations. Similarly, a "carving" effect of the ski is enhanced. FIG. 4 shows layers 15, 16 and 17 making a sandwich or monocoque type construction.

Various modifications of the preferred embodiment may be made. In a first modification, the ski may contain multiple rods 1. According to another modification, there may be multiple slit stops. Further, there may be a single rod 1 extending over the entire length of the ski, or the shape of the rod may be variable. In addition, the mounting may be fixed on the rods, or the rods may be grasped solely between the two slit stops. The system including the rods, tension rods and slit stops may be incorporated under an upper surface of the ski, and the slit stops may act as a slide in which the slit stops are activated when a rod advances in a slit stop, causing the slit stop to spread apart, as well as when the rod retracts from the slit stop, causing constriction of the slit stop.

Various other embodiments and changes may be made thereto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

The invention claimed is:

1. A ski having a sandwich-like or monocoque construction and including a mechanical system that modifies a radial geometry of the ski proportionally to a flexion of the ski, comprising:

a rod including a substantially conical part on a first end thereof and a tension rod on a second end thereof;

a slit stop attached to an upper surface of the ski including a substantially conical bore along an axis of the ski configured to receive the substantially conical part of the rod, and a length axis of the ski corresponding to the length of the ski along the direction of the rod, wherein the slit stop spreads apart when the rod, advances into the slit stop, wherein a radial geometry of a cross-section of a lower surface of the ski substantially perpendicular to the length axis is modified by the spreading of the slit stop, and wherein the rod advances into the slit stop because of a difference in a radius of the rod and a radius of the ski when the ski flexes.

2. The ski according to claim 1, further comprising:

at least a second rod.

3. The ski according to claim 1, further comprising:

at least a second slit stop.

4. The ski according to claim 1, wherein the rod extends over an entire length of the ski.

5. The ski according to claim 1, further comprising:

a mounting fixed on the rod.

6. The ski according to claim 1, wherein a shape of the rod is variable.

7. The ski according to claim 4, further comprising:

a second slit stop, wherein the rod is grasped solely between the slit stops.

8. The ski according to claim 1, wherein the slit stop operates as a slide, wherein the slit stop spreads apart when the rod advances in the slit stop, and wherein the slit stop constricts when the rod retracts from the slit stop.

9. A ski including a mechanical system that modifies a radial geometry of the ski proportionally to a flexion of the ski, comprising:

a rod including a substantially conical part on a first end thereof and a tension rod on a second end thereof;

a slit stop attached to a surface of the ski including a substantially conical bore alone an axis of the ski configured to receive the substantially conical part of the rod, and a length axis of the ski corresponding to the length of the ski along the direction of the rod, wherein the slit stop spreads apart when the rod advances into the slit stop, wherein a radial geometry of a cross-section of a lower surface of the ski substantially perpendicular the length axis is modified by the spreading of the slit stop, wherein the rod advances into the slit stop because of a difference in a radius of the rod and a radius of the ski when the ski flexes, and wherein the rod and slit stop are incorporated under the upper surface of the ski.

* * * * *